US005660502A

United States Patent [19]

Ferguson

[11] Patent Number: 5,660,502

[45] Date of Patent: Aug. 26, 1997

[54] ADJUSTMENT MECHANISM FOR A SCUBA SECOND STAGE AIRFLOW REGULATOR

[75] Inventor: Arthur R. Ferguson, Alameda, Calif.

[73] Assignee: American Underwater Products, Inc., San Leandro, Calif.

[21] Appl. No.: 385,355

[22] Filed: Feb. 8, 1995

[51] Int. Cl.[6] ..... B63C 11/08

[52] U.S. Cl. ..... 405/186

[58] Field of Search ..... 405/186, 185, 405/187; 128/201.27

[56] References Cited

U.S. PATENT DOCUMENTS

| | | | |
|---|---|---|---|
| Re. 31,932 | 7/1985 | Christianson | 137/505.46 X |
| 3,783,891 | 1/1974 | Christianson | 137/491 |
| 4,502,817 | 3/1985 | Long et al. | 405/186 |
| 4,720,281 | 1/1988 | Matsuoka | 405/186 |
| 5,251,618 | 10/1993 | Christianson | 137/494 X |

*Primary Examiner*—William P. Neuder

*Attorney, Agent, or Firm*—Bruce & McCoy

[57] ABSTRACT

An improved adjustment mechanism for a scuba second state air flow regulator comprising a water sealed balance shaft having a cross-sectional area approximately equal to the area of contact between the poppet valve seat and the orifice of the second stage air hose coupling.

1 Claim, 2 Drawing Sheets

ADJUSTMENT MECHANISM FOR A SCUBA SECOND STAGE AIRFLOW REGULATOR

BACKGROUND OF THE INVENTION

1. Field of the Invention

The present invention relates to airflow regulators for self-contained underwater breathing apparatus for underwater divers. Compressed air up to 4,500 pounds per square inch is contained in one or more tanks which mount on the back of the diver in a cradle which is secured by straps to the diver's body. The compressed air from the high pressure cylinder flows through a regulator assembly, to reduce the high pressure of the air in the tank to the ambient pressure surrounding the diver's lungs, making the air from the cylinder safe and breathable by the diver. The regulator provides the diver with air upon demand and automatically controls the flow of air to the diver.

There are several types of scuba regulators in use but they are differentiated by the number of stages and hoses utilized in their design. The stages of a regulator refer to the number of reductions in pressure that air stored in the diver's tank will experience before it is reduced to the ambient pressure of the diver's lungs. Most regulators currently in use reduce the air pressure in two stages through two separate mechanisms. The first pressure reduction is accomplished in a first stage regulator which is mounted on the tank and reduces the tank pressure to an intermediate pressure usually between 110 and 185 psi above the ambient pressure. A single relatively small diameter hose is connected between the first stage to a second stage regulator which further reduces the air pressure to ambient pressure. The second stage regulator is connected to the diver's mouthpiece and responds to the diver's need by providing breathable air reduced to ambient at the mouthpiece for inhalation by the diver. The flow of air into the mouth piece is intermittent and automatic in response to the diver's breathing and it can be triggered to free flow. Exhaled air is exhausted from the second stage regulator directly into the surrounding water.

More particularly, the present invention relates to an improved air flow adjustment mechanism for a scuba second stage scuba regulator, of the current design which is independent of the first stage regulator and is associated with the mouthpiece through which the diver receives the air from the tank.

DESCRIPTION OF THE PRIOR ART

Most second stage regulators currently in use incorporate or utilize downstream valves to ensure the free flow of air. This means that the valve seat is situated on the downstream side, or air release side, of the valve assembly, and opens with the flow of air rather than attempting to open against it. This is considered to be an important design safety feature since it allows the intermediate air pressure to assist in opening the valve. If the first stage valve should malfunction, the high pressure air would not damage the hose or the second stage, but instead would open the second stage valve and cause the regulator to free flow thereby providing air to the diver for an emergency ascent. Second stage regulators contain a diaphragm chamber, open on the outside to water pressure, and into which air from the tank is released to keep the diaphragm extended.

A downstream second stage valve incorporates the use of return spring pressure and a small lever to operate the air flow valve which inlets air to the diaphragm chamber. As the diver inhales, the pressure in the chamber is lowered, and this causes the diaphragm to collapse and move inward and press the valve lever. This raises the valve off the seat causing the intermediate stage air to enter the diaphragm chamber of the second stage regulator. When the diver stops inhaling, the pressure increases from the air coming into the regulator and the diaphragm moves back out releasing the valve lever stopping the flow of air. When the diver exhales, his exhausted air travels through a one-way exhaust valve mounted in the regulator and out the exhaust port.

The lever actuated air flow valve to the diaphragm chamber of the second stage regulator is maintained closed by spring pressure. This pressure is created by two separate and different springs which are combined for effect but function for different purposes. The first spring is a constant pressure spring which is engaged with the valve seat which closes the air inlet orifice. The orifice is an integral part of the air hose bayonet type quick release coupling or threaded coupling that engages the air delivery hose to the regulator. The second spring pushes a piston which also bears against the valve stem of the valve seat which closes the air inlet orifice. The pressure of this spring can be adjusted by turning a knob on the side of the regulator which increases or decreases the pressure on the spring and in turn on the piston thereby increasing or decreasing the total pressure on the valve which closes the air inlet orifice. This assembly permits control of the spring pressure on the air inlet valve seat to make it adjustable whereby the air flow rate through the regulator can be controlled to provide an air flow rate adjusted to the diver's personal comfort and selection.

The problem with these regulators are twofold. The first is that the adjusting mechanism is exposed to the water so that salt crystals can form and grit can penetrate the mechanism causing degradation of its operation. The second problem is that the adjustment of the second stage opening or control effort in most regulator designs does not remain constant as the diver's depth changes. It is the purpose of the present invention to provide a sealed adjustment mechanism that is depth compensated.

SUMMARY OF THE INVENTION

It is the purpose of the present invention to provide an improved adjustment mechanism for a scuba second stage airflow regulator which includes a housing, an adjustment tube located at one end of the housing, and an air inlet coupling receptacle mounted in the housing in opposed and aligned relation to the adjustment tube. The adjustment tube contains an adjustment shaft journalled therein which is threadably engaged with an adjustment slide arranged to reciprocate longitudinally in the tube when the adjustment shaft is rotated in its journals therein. The adjustment slide is interconnected to a piston through a compression spring. The air inlet receptacle contains a poppet valve having a seat for sealing with a standard orifice of the male member of a standard scuba air hose coupling. The valve seat is secured to the end of a valve stem which is mounted for reciprocating movement in alignment with the adjustment shaft mounted in the adjustment tube.

The improved mechanism comprises a balance shaft aligned with and bearing on the valve stem and pushed upon by the piston in the adjustment tube. The balance shaft extends from the adjustment tube through a watertight seal. The cross-sectional area of the balance shaft at the point of contact with the seal is approximately equal to the area of contact between the poppet valve seat and the orifice of the air hose coupling.

OBJECTS OF THE INVENTION

It is therefore an important object of the present invention to provide a new and improved adjustment mechanism for a scuba second stage airflow regulator.

It is another object of the present invention to provide an adjustment mechanism for a second stage airflow regulator which is sealed to prevent the intrusion of salt water and grit.

It is a further object of the present invention to provide an adjustment mechanism for a scuba second stage airflow regulator which compensates for depth variation to maintain approximately the same opening effort throughout a dive.

Other objects and advantages of the present invention will become apparent when the apparatus of the present invention is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
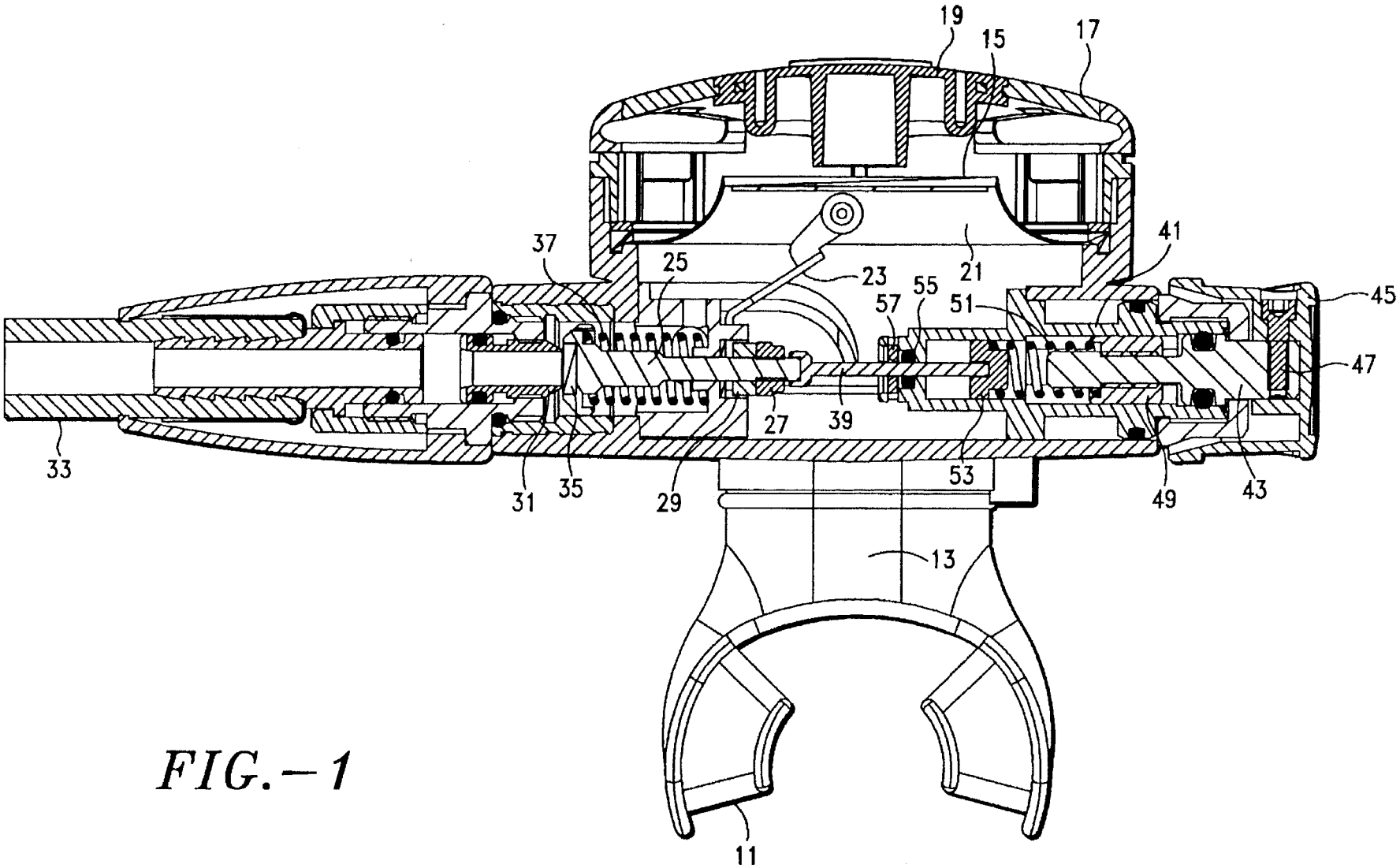
FIG. 1 is a side elevation in cross-section illustrating the improved adjustment mechanism of a scuba second stage airflow regulator.

Reference is made to FIG. 1 of the drawings which illustrates in cross-section an improved adjustment mechanism for a scuba second stage airflow regulator. The regulator includes a mouthpiece 11 which the diver bites onto whereby the weight of the regulator is carried in the diver's teeth. The mouthpiece is a soft, pliable material and has a passageway 13 which extends into the interior of the regulator. In opposed relation to the mouthpiece, at the other end and at the front of the regulator, is the diaphragm 15 containment chamber 17, which usually has a cylindrical configuration. In most designs, a purge button 19 on the front of the containment chamber mechanically actuates the diaphragm.

The purpose of the purge button 19 is to open the air flow valve and allow the intermediate pressure air from the first stage regulator to fill the diaphragm chamber 21 and flush any water in the chamber out the exhaust valve. The purge button could be indirectly interconnected to the air flow poppet valve, but since deflection or collapsing of the diaphragm causes the air flow valve to open, as will be explained, the simplest way of effecting a purge is to provide a direct acting piston to mechanically collapse the diaphragm. The purge button is a floating piston supported In a bellows mechanism which positions the piston adjacent the outside of the diaphragm.

Collapsing the diaphragm 15 actuates a lever arm 23 positioned adjacent the inside of the diaphragm. The lever is pivoted at its inboard end opposite from its roller contact with the diaphragm. It is engaged with the stem 25 of the poppet valve by means of a lock nut 27 and spacer 29, the first of which is threadably engaged to the poppet valve stem. Actuating the lever by collapsing the diaphragm opens the poppet valve, which is held closed by spring pressure, by moving the stem to the right and off the valve office 31 on the air inlet hose 33. The poppet valve dosing spring pressure can be adjusted by means of the lock nut 27 that is threaded onto the end of the poppet valve stem.

Figure 2:
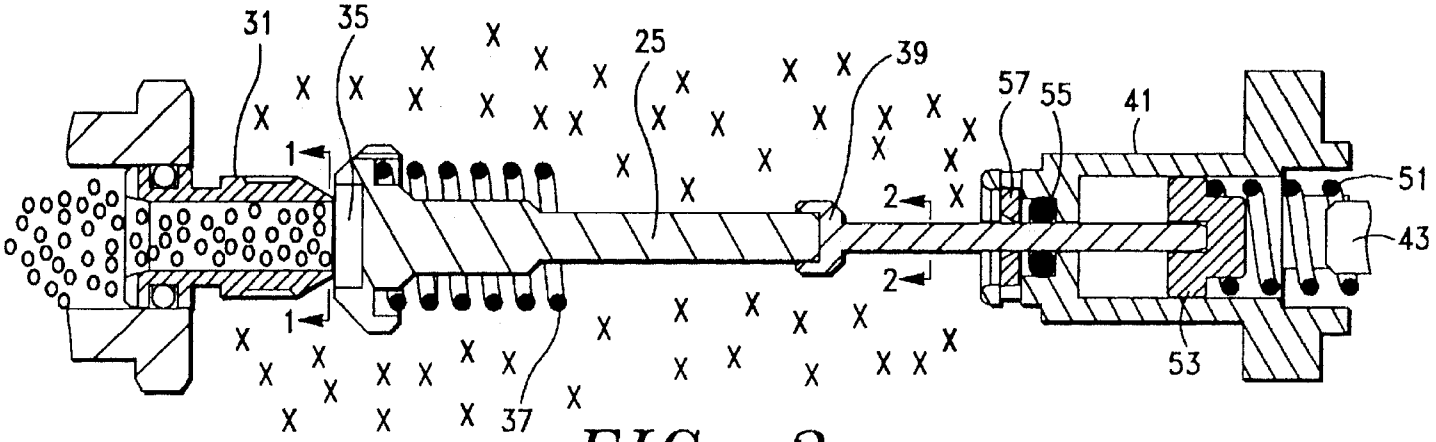
FIG. 2 is a schematic diagram of the working mechanism of the adjustment mechanism for the present invention.

Reference is made to FIG. 2 for a partially broken out schematic drawing of the poppet valve stem 25 and the valve seats. The seat 35 on the poppet valve bears against the bayonet type office 31 which is integral to the coupling that secures the air inlet hose 33 to the regulator body. A threaded inlet coupling is the standard in use with the male member of the hose being received in the female air inlet coupling receptacle mounted in the regulator housing. Some couplings use a quick disconnect fitting to secure the air hose to the second stage regulator.

Referring to FIGS. 1 and 2: air is inletted to the diaphragm chamber 21 as a result of either of two actions: Air intake by the diver causing the diaphragm 15 to be collapsed towards the mouthpiece thereby depressing the lever arm 23 and opening the poppet valve permitting intermediate pressure air to flow into the regulator housing to replace the air taken in by the diver thereby equalizing the pressure in the regulator and allowing the diaphragm to move outward and close the valve. Alternatively, the purge button 19 can be pushed to actuate the lever arm mechanically and open the valve and flush any water that has penetrated the diaphragm chamber of the regulator out the exhaust. Depressing the purge valve to open the poppet valve while the diver holds his breath, and instead of intaking water and air, allows the air to blow the water out the exhaust valve; a one-way valve which generally prevents water from intruding back into the regulator.

Referring to FIG. 1: The pressure at which the diver's breathing opens the poppet valve, by air intake into his lungs, can be adjusted by the mechanism on the opposite side of the regulator in opposed relation to the air inlet coupling and receptacle. The purpose of this mechanism is to provide an additional adjustable force on the stem 25 of the poppet valve for the purpose of holding the poppet valve seat 35 closed against the air inlet hose orifice 31. This is effected by providing additional spring pressure to that which is the constant pressure imposed on the poppet valve by the first spring 37.

Reference is made to FIGS. 1 and 2: A balance shaft 39 extends from an adjustment tube 41 which is mounted in the side of the regulator housing. The adjustment tube includes an adjustment shaft 43 which is journalled therein to rotate in place. An adjustment knob 45 is secured to the end of the adjustment shaft by means of a cap screw 47 which holds the knob in place on the shaft. Rotation of the knob by the diver rotates the shaft in the adjustment tube. An internally threaded slide member 49, usually hexagonal in shape in its external configuration, is mounted in sliding relation inside the adjustment tube and is threadably engaged with the adjustment shaft. The slide member is prevented from rotating by the internal configuration of the adjustment tube whereby it reciprocates longitudinally inside the adjustment tube as the shaft is rotated in one direction or the other. The adjustment slide bears against a second spring 51 and either compresses it or relaxes it depending upon the direction of rotation of the cap or knob secured to the adjustment shaft. The spring in turn bears against a piston 53 which reciprocates in the adjustment tube, and the piston bears against the end of the balance shaft 39.

The balance shaft 39 extends through the end of the adjustment tube 41 through a seal provided by an O ring 55 held in place by a snap washer 57 which is located in a radial opening in the end of the adjustment tube to restrain the O ring. The spring pressure supplied by the adjustment shaft 43 to the balance shaft adds additional pressure to the end of the stem 25 of the poppet valve for the purpose of increasing the total pressure on the poppet seat 35 whereby the total opening pressure for the valve is controllable by the diver through the external adjustment knob 45. The balance shaft is aligned with and bears on the valve stem, and is pushed upon by the piston 53 in the adjustment tube, and the balance shaft extends from the adjustment tube through a watertight seal provided by the O ring.

Figure 3:
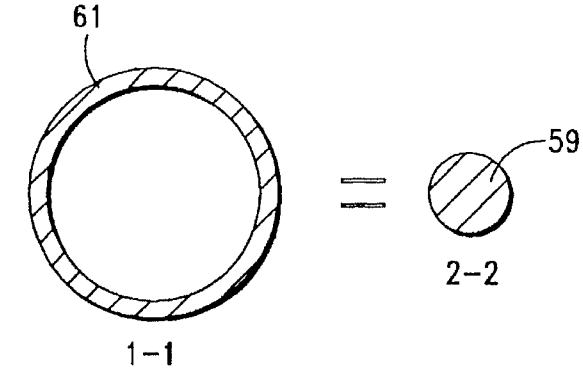
FIG. 3 is a diagram of the relative cross-section of the balance shaft and the seat to cone contact area.

Reference is made to FIGS. 2 and 3. The cross-sectional area 59 of the balance shaft 39 at the point of contact with the seal 55 is approximately equal to the area of the contact 61 between the poppet valve seat and the air inlet orifice of the air hose (shown is cross-hatching in FIG. 3). Ambient pressure (X) exists in the regulator while second stage pressure (O) exists in the air inlet hose 33. In a conventional mechanically balanced second stage regulator, as ambient pressure increases when the diver descends, the second stage opening effort increases due to the ambient pressure acting only in the closing direction against the area 61 where the poppet valve seat contacts the inlet orifice. In the present invention, this force increase is essentially eliminated by having the balance shaft, with a cross sectional area 59 approximately equal to the valve seat contact area 61, sealed off from the ambient pressure. This balance shaft area of force decrease with depth balances the valve seat area force increase with depth resulting in the same second stage opening effort at all depths.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. An improved adjustment mechanism for a scuba second stage airflow regulator having a housing, an adjustment tube located at one end of said housing, and an air hose inlet coupling receptacle mounted in said housing in opposed and aligned relation to said adjustment tube, said adjustment tube containing an adjustment shaft journalled therein and threadably engaged with an adjustment slide arranged to reciprocate longitudinally in said tube when said adjustment shaft is rotated in its journals therein, said adjustment slide being interconnected to a piston through a compression spring, said air hose inlet receptacle containing a poppet valve having a seat for sealing with a bayonet type orifice of the male member of a standard scuba air hose coupling, said valve seat being secured to the end of a valve stem which is mounted for reciprocating movement in alignment with said adjustment shaft mounted in said adjustment tube, said improved mechanism comprising, a balance shaft aligned with and bearing on said valve stem and being pushed upon by said piston in said adjustment tube, said balance shaft extending from said adjustment tube through a watertight seal, and the cross-sectional area of said balance shaft at the point of contact with said seal being equal to the cross-sectional area of contact between said poppet valve seat and said bayonet type orifice of said air hose coupling.

* * * * *